United States Patent [19]

Allen et al.

[11] 4,062,314

[45] Dec. 13, 1977

[54] MAGNETICALLY OPERATED WARNING DEVICE

[75] Inventors: Shelby A. Allen, Fairdale, Ky.; Neville R. Black, Louisville, Ky.

[73] Assignee: Charles Nick Morris, Louisville, Ky.

[21] Appl. No.: 724,647

[22] Filed: Sept. 20, 1976

[51] Int. Cl.[2] ..... G08B 13/08

[52] U.S. Cl. ..... 116/85; 49/13; 116/86

[58] Field of Search ..... 116/85, 86, 91, 95, 116/100, 96; 337/205; 49/13, 14; 160/10; 340/274

[56] References Cited

U.S. PATENT DOCUMENTS

| | | | |
|---|---|---|---|
| 2,600,581 | 6/1952 | Schenendorf | 340/274 X |
| 2,735,397 | 2/1956 | Bishop | 116/100 |
| 3,451,373 | 6/1969 | Fox et al. | 116/100 X |
| 3,516,036 | 6/1970 | Lea | 116/85 |
| 3,890,476 | 6/1975 | Canter | 335/205 X |

*Primary Examiner*—Daniel M. Yasich
*Attorney, Agent, or Firm*—Maurice L. Miller, Jr.

[57] ABSTRACT

A signaling device for use with a closure which is movably mounted within a frame having a housing, and a vibratile member mounted on the housing. A striker pin is mounted on the housing. A biasing spring is disposed about the pin and tends to maintain the striker pin at an intermediate rest position spaced from the vibratile member. A magnet is adapted for mounting in movable relation to the housing in accordance with the movement of the closure, for magnetically holding the striker pin in a retracted striking position spaced from the vibratile member when the closure is disposed in a pre-selected position in the frame, and for releasing the striker pin to permit the striker pin to overcome the biasing force of the spring and strike the vibratile member when the closure is moved away from the pre-selected position. The device may also include a second magnet adapted for mounting in movable relation to the housing in accordance with the movement of the closure, for positively forcing the striker pin into the vibratile member when the closure is moved away from its pre-selected position in the frame.

13 Claims, 4 Drawing Figures

MAGNETICALLY OPERATED WARNING DEVICE

BACKGROUND OF THE INVENTION

This invention relates to sonic signaling devices for use with closures such as sliding panels, windows, drawers, hatches and swinging doors, and more specifically, to magnetically actuated door chime warning devices.

Door chimes have long been employed in the prior art to alert an individual within a home, office, store or shop that a door to the premises is being opened. Numerous schemes for affecting sonic signaling in response to the opening of door have been proposed. However, such prior art devices have generally been characterized by complex mechanical mechanisms which scuff and mar the area where they are installed and require frequent servicing. Other such devices are electrically operated and are thus dependant upon the effective operation of the electrical service on the premises in which the sonic device is employed.

Our invention substantially overcomes these and other prior art difficulties.

SUMMARY OF THE INVENTION

Briefly, in accordance with our invention, we provide a signaling device for use with a closure which is movably mounted within a frame, including means defining a housing and a vibratile member mounted on the housing. Means for striking said vibratile member is also mounted on the housing. Biasing means tending to maintain the striking means at an intermediate rest position spaced from the vibratile member is included. Magnetic holding and releasing means is provided which is adapted for mounting in movable relation to the housing in accordance with a movement of the closure, for magnetically holding the striking means in a retracted striking position spaced from the vibratile member when the closure is disposed in a pre-selected position in the frame, and for releasing the striking means to permit the striking means to overcome the biasing means and strike the vibratile member when the closure is moved from the pre-selected position.

DESCRIPTION OF THE PREFERRED EMBODIMENTS

Figure 1:
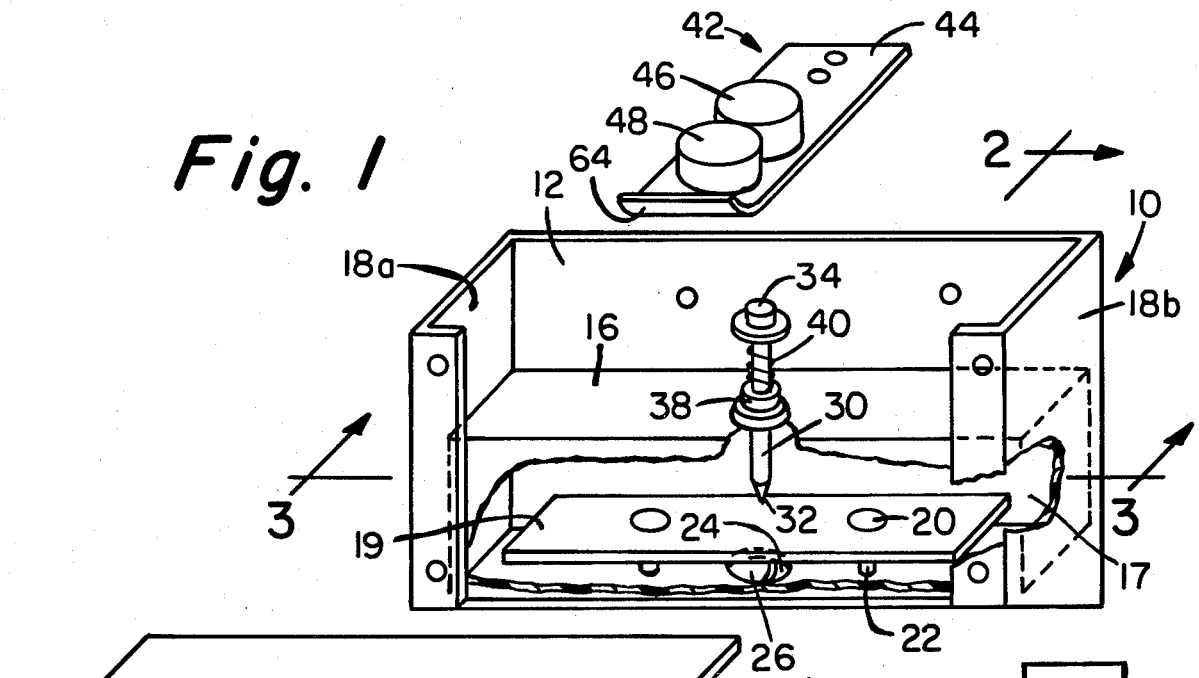
FIG. 1 shows an exploded oblique view of a magnetically actuated door chime thus illustrating one preferred embodiment of the subject invention.
Figure 4:
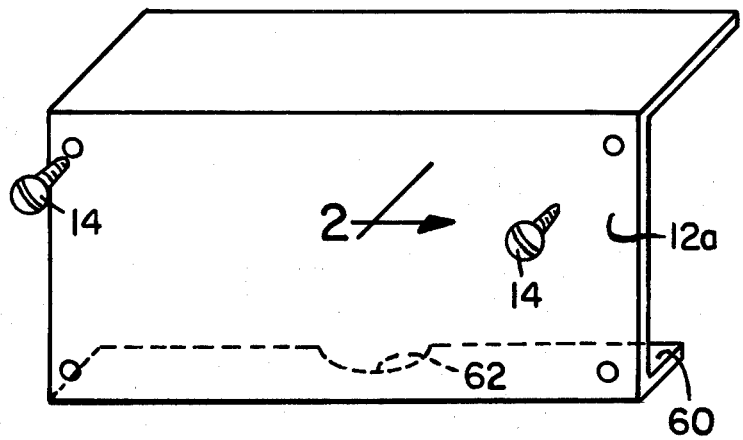
FIG. 4 shows a plan view of a magnetic drive unit, a component of the device shown in FIGS. 1–3.
Figure 4:
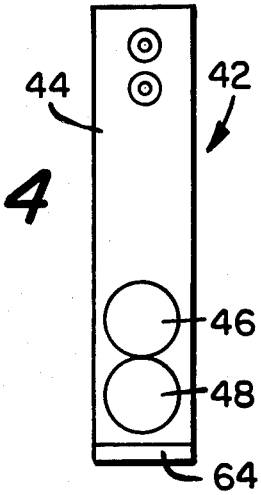

Referring now to the Figures, there is shown, in one preferred embodiment of our invention, a magnetically actuated door chime assembly 10 having a housing 12 which may be formed of metal, molded plastic, wood or other suitable material. A removable back **12*a*, preferrably formed of the same material as the housing 12, may be attached to the latter by means of suitable fasteners 14 to form a compact and attractive enclosure for the assembly 10**.

Within the housing 12 there is disposed a hollow tube 16 having a square shaped cross-section extending horizontally across the housing 12 between a pair of sidewalls **18*a*, 18*b*. The tube 16 defines a chamber 17 within which is disposed a vibratile member consisting of a metal chime bar 19 supported by a pair of rubber spacers 20 attached through holes in the bottom side of the tube 16 as shown at 22. The chime bar 19 is of flat rectangular construction, and is a standard item available in the art. It should be selected to give the desired tonal quality and frequency of vibration. The dimensions of the chamber 17 should be selected so that the bar 19 is supported therein by the spacers 20 without touching the sides of the tube 16 so that a tone generated by the bar 19 will not be unnecessarily dampened. However, within these limits, it is preferrable that the horizontal dimensions of the bar 19 be nearly equal to the horizontal dimensions of the chamber 17. This will permit the chamber 17 as defined by the tube 16 to act as an efficient sonic resonator for the tone generated by the bar 19. The spacers 20 are readily available items and are formed of rubber or other elastic resilient material so as to minimize the dampening effect on the vibrating chime bar 19**.

A circular hole 24 is formed in the bottom of the resonator tube 16 to allow the tonal vibrations of the chime bar 19 to escape the chamber 17. A circular disc 26, pivotally attached near its periphery to a pivot pin 28, can be slid by hand across the hole 24 to reduce or attenuate the amplitude of the sound produce by the bar 19 and emanating from the chamber 17. By completely closing off the hole 24 with the disc 26, the sound emanating from the assembly 10 when the bar 19 is activated can be nearly eliminated. Thus, by simply closing off the hole 24, the assembly 10 can be affectively deactivated. Conversely, the disc 26 can be slid off of the hole 24 to expose an increasing surface area thereof to increase the intensity of the sound emanating from the chamber 17 to any desired level, up to the maximum capacity of the resonator tube 16.

The chime bar 19 is set into vibration by a striking means consisting of a strike pin 30 which is disposed above the bar 19 and inserted through the top surface of the tube 16 into the chamber 17. The shaft of the pin 30 may, for example, be formed of brass, while the striking end 32 thereof may be formed of plastic and preferrably molded into a relatively sharp point. The plastic tip or end 32 may be joined to the lower end of the shaft by epoxy or other suitable binding agent.

The top of the strike pin 30 contains a cap 34 formed of a ferrous material and permanently magnetized in any well known manner. The strike pin 30 is inserted through a suitable guide 38 adapted to maintain the pin 30 in a vertical position, and thence, through the top surface of the tube 16. Biasing means consisting of a coiled spring 40 surrounds the pin 30 between the bottom of the cap 34 and the guide 38. The spring 40 should be selected to support the weight of the cap 34 and attached pin 30 so that the striking end 32 is spaced slightly above the chime bar 19 when no external magnetic forces are acting upon the pin 30. Such a position of rest of the strike pin 30 is illustrated in FIG. 3.

Figure 2:
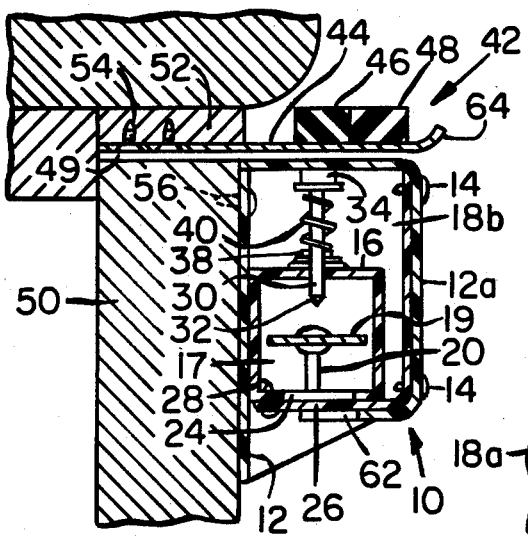
FIG. 2 shows a side elevation view in cross-section of the door chime of FIG. 1 as preferably mounted on a door and door frame.

The strike pin 30 is actuated by a magnetic drive unit 42 which includes a base 44 and a pair of oppositely polarized disc shaped permanent magnets 46 and 48. The base 44 may consist of a suitably thin rectangular strip of nonferrous supportive material such as aluminum or the like, and should be thin enough to insert in a space 49 between the top of the door 50 and an overlying door frame 52 with some slight additional room to spare so as to permit the door 50 to swing freely between an open and closed position without binding against and damaging the base 44. The base 44 may be secured to the door frame 52 in any suitable manner, such as by means of wood screws 54, so that the magnets 46 and 48 project out beyond the side of the door 50 when the latter is in a closed position as shown in FIG. 2. The magnets 46 and 48 may be secured to the base 44 in any suitable manner such as with epoxy or other suitable binding agent.

The assembly 10 should be attached to the top side of the door 50 so that, when the door 50 is closed as shown in FIG. 2, the magnetic cap 34 on the strike pin 30 is directly beneath the magnet 46. The polarities of the cap 34 and magnet 46 should be opposite one another so that, when the door 50 is in the closed position, the cap 34 and pin 30 is attracted upward by the magnet 46 against the inside roof of the back 12*a*. This is the strike position of the pin 30 and, in such a position, the cap 34 is lifted off the top of the spring 40. The spring 40 thus sits freely upon the guide 38 in a relaxed state when the strike pin 30 is in the strike position.

Figure 3:
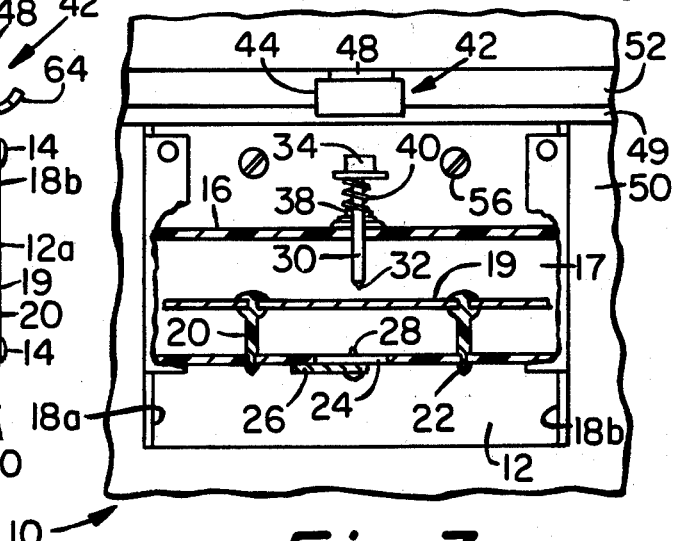
FIG. 3 shows a rear elevation view of the door chime of FIG. 2 with the back thereof removed as preferrably mounted on a door and door frame.

The top surface of the back 12*a* should be approximately flush with the top margin or edge of the door 50, and the assembly 10 may be secured to the door in any convenient manner such as by means of wood screws 56 as shown in FIGS. 2-3. In the alternative, the assembly 10 may be secured to the door 50 with a suitable adhesive tape.

Now as the door 50 is opened (to the right as viewed in FIG. 2), the assembly 10 moves to the right until the magnetic cap 34 passes out of the attractive field of the magnet 46 and into the repulsive field of the oppositely polarized magnet 48, at which point the pin 30 is magnetically forced downward to strike the chime bar 19. During a latter portion of its downward travel, the cap 34 engages the top of the spring 40 and drives the latter into compression as the pin 30 completes the striking operation. Thus, upon completion of the striking operation, the spring 40 lifts the pin 30 off the surface of the bar 19 so that the vibration of the bar 19 will not be dampened. With the door 50 in an open position, wherein the assembly 10 is in a position remote with respect to the drive unit 42, the pin 30 is held by the spring 40 in a position of rest above and spaced from the bar 19 as shown in FIG. 3. When the door 50 is returned to the closed position as shown in FIG. 2, the magnet 46 attracts the cap 34 and raises the pin 30 off the spring 40 from the rest position as shown in FIG. 3 to the strike position as shown in FIG. 2. A bottom flange 60 of the back 12*a* may be formed to define a semi-circular notch 62 so as to allow complete exposure of the hole 24 to the surrounding atmosphere when the back 12*a* is secured to the housing 12. A front lip 64 may be formed on the base 42 by curling the end projecting beyond the door 50 upwardly to provide skid means against which the door 50 may slide so as to keep from damaging the unit 42 as when the door 50 sags or twists out of its proper alignment. Although we prefer installing the assembly 10 and magnetic drive unit 42 at the top of the door 50 and frame 52, respectively, the two units 10 and 42 could also be installed along the free swinging side of the door 50 and the opposing door frame. The signaling device would operate in the same manner as before except that, with sidewise door mounting, gravity could not be utilized to aid in accelerating the pin 30 against the bar 19 during the striking operation.

The magnet 46 serves as a magnetic holding and releasing means for mounting in movable relation to the housing 12 in accordance with a movement of the door 50. Where gravity can be relied upon to allow the pin 30 and cap 34 to drop into the spring 40 to overcome the biasing force thereof and strike the bar 19, the magnet 48 may be dispensed with. The magnet 48 is needed only when a strong positive driving force is desired to repel the pin 30 against the bar 19 to produce a strong vibration or where gravity cannot be utilized to accelerate the pin 30 against the bar 19.

Also, it should be noted that the housing 12 can be adapted for mounting on the frame 52 while the unit 42 may be adapted for mounting on the door 50 for movement therewith. It is only necessary to our invention that the magnet 46, and the magnet 48 when used, be mounted in movable relation to the housing 12 in accordance with the movement of the door 50.

Lastly, it should be apparent to those skilled in the art that our invention can readily be adapted for use with a variety of closures besides doors such as for example, windows, drawers, sliding panels, hatches, hingable covers and so forth. Moreover, particularly in the case of a sliding panel, the assembly 10 and magnetic unit 42 may be positioned relative to one another so that the chime 19 can be struck when the closure is moved away from any desired pre-selected position. Thus, the warning device is adaptable for operation when the closure is moved from an open position toward a closed position as well as when moved from a closed position toward an open position.

Although the subject invention has been described with respect to specific details of a single preferred embodiment thereof, it is not intended that such details limit the scope of the subject invention except insofar as is set forth in the following claims.

We claim:

1. A signaling device for use with a structure defined by a movable closure member mounted in a stationary frame member, said device comprising a housing for mounting on said closure member for movement therewith, a vibratile element mounted on said housing, striker means having an upper and lower end and being translatably mounted on said housing above said vibratile element, biasing means confined between said upper end and said housing tending to support said striker means at an intermediate rest position wherein said lower end is spaced above said vibratile element, a magnetically attractable cap attached to said upper end of said striker means, and magnetic holding means for mounting on said frame member above said closure member, for attracting said cap and striker means upward from said rest position to a retracted striking position to relax said biasing means when said closure member is disposed with respect to a pre-selected position in said frame member, and for releasing said cap and striker means to permit them to fall with the aid of gravity to overcome said biasing means and strike said vibratile element when said closure member is moved away from said pre-selected position.

2. The device of claim 1 further comprising magnetic repelling means adapted for mounting on said frame member adjacent said holding means for magnetically repelling said cap and striker means downward from said striking position to overcome said biasing means and strike said vibratile element when said closure member is moved away from said pre-selected position, said cap being magnetically polarized in opposing relation to the magnetic polarity of said repelling means.

3. The device of claim 2 further comprising a base relatively thin non-magnetic supportive material, said magnetic holding and repelling means being attached to said base.

4. The device of claim 1 further comprising a sonic resonator mounted on said housing and defining a resonator chamber for said vibratile element.

5. The device of claim 4 wherein said vibratile element is mounted in said chamber.

6. The device of claim 4 further comprising attentuating means for varying the amplitude of a sonic signal emanating from said chamber movably connected to said resonator.

7. The device of claim 1 wherein said striker means comprises a cylindrically shaped pin.

8. The device of claim 1 further comprising a base of relatively thin non-magnetic supportive material, said magnetic holding means being attached to said base.

9. The device of claim 8 further comprising skid means connected to said base to protect said base from damage in the event said closure member should move into said base as said closure member is moved relative to said frame member.

10. The device of claim 1 further comprising spacer means constructed of resilient material for supporting said vibratile element.

11. A sonic signaling device for use with a structure defined by a closure which is movably mounted within a frame comprising means defining a housing for mounting on said closure for movement therewith, a sonic generator mounted on said housing, magnetized means for actuating said sonic generator movably mounted on said housing for linear translation relative to said housing in response to a magnetic force exerted thereon, biasing means confined between said actuating means and housing tending to maintain said actuating means at an intermediate position of rest, such that said generator is inoperative, first magnetic means for mounting on said frame for magnetically maintaining said actuating means in a retracted striking position away from said rest position to relax said biasing means when said closure is disposed with respect to a pre-selected position in said frame, and second magnetic means for magnetically driving said actuating means to an advanced position to actuate said generator when said closure is moved with respect to said pre-selected position.

12. A signaling device for use with a door which is swingably mounted within a frame comprising means defining a housing for mounting on said door for movement therewith, a vibratile member mounted on said housing, means for striking said vibratile member movably mounted on said housing above said vibratile member for linear translation toward and away from said vibratile member, a magnetized cap attached to said striking means, biasing means confined between said striking means and housing tending to support said striking means and cap at an intermediate rest position with said striking means being spaced above said vibratile member, a base of relatively thin non-magnetic material adapted for partial disposition into a space between an edge of said door and said frame and for attachment to said frame, and a pair of magnets mounted adjacent one another on a portion of said base projecting beyond said frame above the path of said door, said magnets being oppositely polarized relative to one another such that one of said pair attracts said cap and striking means to a retracted striking position to relax said biasing means when said door is closed in said frame, and such that the other of said pair repels said cap and striking means against said biasing means and vibratile member when said door is swung from a closed position in said frame toward an open position relative to said frame.

13. A sonic signaling device for use with a structure defined by a movable closure member mounted in a stationary frame member, said device comprising a housing for mounting on one of said members, a vibratile element mounted on said housing, magnetized means for striking said element movably mounted on said housing, biasing means confined between said striking means and said housing tending to maintain said striking means minimally spaced from said element, and first magnetic means for mounting on the other of said members, for magnetically attracting said striking means away from said element to a retracted striking position maximally spaced from said element to relax said biasing means when said closure member is in a pre-selected position relative to said frame member, and second magnetic means for mounting on the other of said members for repelling said striking means against said biasing means and element to produce a sonic vibration when said closure is moved away from said pre-selected position.

* * * * *